United States Patent [19]

Freermann

[11] Patent Number: 4,548,141

[45] Date of Patent: Oct. 22, 1985

[54] APPARATUS FOR APPLYING RIBBON STRIPS TO A TEXTILE FABRIC

[75] Inventor: Johannes Freermann, Ochtrup, Fed. Rep. of Germany

[73] Assignee: Carl Schmale GmbH & Co. KG, Ochtrup, Fed. Rep. of Germany

[21] Appl. No.: 653,433

[22] Filed: Sep. 21, 1984

[30] Foreign Application Priority Data

Sep. 24, 1983 [DE] Fed. Rep. of Germany ..... 3334646

[51] Int. Cl.[4] ..... D05B 3/22

[52] U.S. Cl. ..... 112/113; 112/147; 112/153; 112/121.27

[58] Field of Search ..... 112/147, 152, 104, 113, 112/121.27, 121.26

[56] References Cited

U.S. PATENT DOCUMENTS

| | | | |
|---|---|---|---|
| 3,792,672 | 2/1974 | Friedman et al. | 112/121.26 |
| 4,030,429 | 6/1977 | Boser et al. | 112/152 X |
| 4,048,931 | 9/1977 | Hodgins | 112/121.27 |
| 4,114,544 | 9/1978 | Miyachi et al. | 112/104 |
| 4,137,856 | 2/1979 | Brauns et al. | 112/104 |
| 4,502,399 | 3/1985 | Seaman | 112/121.27 |

FOREIGN PATENT DOCUMENTS

| | | | |
|---|---|---|---|
| 2130820 | 9/1972 | Fed. Rep. of Germany | 112/113 |
| 2841586 | 5/1980 | Fed. Rep. of Germany | 112/113 |

*Primary Examiner*—H. Hampton Hunter

*Attorney, Agent, or Firm*—Karl F. Ross; Herbert Dubno

[57] ABSTRACT

An apparatus for putting ribbon pieces on a textile fabric's edge comprising a ribbon folding apparatus with a fold plate having two long sides with slanting, converging fold edges and two fold plate stops engageable by the slanting fold edges and a fold edge on its front side lying parallel to the textile fabric's feed direction which is engageable with the ribbon alternatively to the slanting fold edges so as to make ribbon pieces that are V-shaped or simply folded over on themselves; and a ribbon feed apparatus having a ribbon oriented transverse to and adjustably perpendicular to or at an acute angle to the textile fabric's plane of motion, a ribbon-holding clamp positioned above the fold edge's point of engagement with the ribbon to support the ribbon prior to engagement with the fold plate, and a ribbon cutting apparatus mounted in the feed direction above the place of engagement of the ribbon by the fold plate.

7 Claims, 24 Drawing Figures

6
14
17
21
13
16
17
21
17
5'
22
16
14
17
27
7
22
18
4
5'
6
12
20

8'
4
18
19
25
26
6
1'
11'
9'
10'
2'
E
3'
5'
14
7
22
F

APPARATUS FOR APPLYING RIBBON STRIPS TO A TEXTILE FABRIC

FIELD OF THE INVENTION

My present invention relates to an apparatus for applying ribbon strips, cut from a continuous band and folded upon a textile in a predetermined relationship to an edge thereof, e.g. for affixing by a sewing machine or other means.

BACKGROUND OF THE INVENTION

An apparatus of the above mentioned type for putting a ribbon piece cut and folded from a ribbon band, strip or web on an edge of a moving textile fabric or the like, can be used to position the strip section for subsequent sewing, e.g. in the application of labels, hook engaging loops or the like to towels, garments, etc.

In such apparatus the ribbon can be fed to a folding unit by a feed unit, the folding unit being coupled with an adjustable ribbon cutting unit to make a suitably folded ribbon piece which is transported subsequently by a conveying unit to a textile fabric to which it is applicable and held thereon under a piece holder until the fabric reaches, e.g. the sewing machine.

The ribbon folding unit can have a fold plate oriented transversely to the ribbon feed unit.

The fold plate can be slidable back and forth across the ribbon feed path and may engage and thereby fold a portion of the ribbon.

The conveying apparatus can include a conveying clamp located at about the same level as the feed channel of the fold plate. This clamp has a first upper clamp jaw and a second lower clamp jaw conformed and positioned to engage and hold the fold plate, the first upper clamp jaw pressing against the upper surface of the fold plate and the second lower clamp jaw pressing against the under surface of the fold plate. The conveying clamp is constructed to be lowerable to the feed path of the textile fabric and is slidable parallel to the textile fabric until it reaches the piece holder.

An adjustable ribbon-holding clamp is positioned behind the conveying clamp at the end of the ribbon feed path to support the ribbon as it is cut. The conveying clamp is movable parallel to the textile fabric feed direction by a belt drive mechanism or the like which is constructed to move the conveying clamp with a velocity equal to that of the textile fabric.

Such an apparatus is described in German patent DE-PS No. 21 30 820 and in German patent DE-PS No. 28 41 586.

While these devices are essentially highly functional and useful, each of them has difficulties.

For example only U-shaped ribbon segments can be produced by the apparatus according to DE-PS No. 28 41 586, but with the apparatus according to German patent DE-PS No. 21 30 820 only V-shaped ribbon pieces can be positioned on the textile fabric.

In the prior art, therefore, each time a different type of ribbon piece was attached a different machine had to be constructed. For short runs for a particular shape of ribbon piece a new and different apparatus could not be economically constructed.

OBJECT OF THE INVENTION

It is an object of my invention to provide an apparatus which will apply a ribbon piece on the edge of a textile fabric selectively in a V-shape, U-shape or a shape formed by folding the cut ribbon back on itself, for example a rectangular shape.

SUMMARY OF THE INVENTION

I have found that this object, and others which will become apparent hereinafter, are attained by providing an additional fold edge on the front side of the fold plate positioned parallel to the direction of motion of the textile fabric (and perpendicular to the transverse direction of movement of the fold plate) as an alternative to the meeting slanting fold edges on the sides of the fold plate hitherto invariably employed, an additional ribbon fed transverse to and either perpendicular, slightly tilted from the perpendicular, or slanted at an angle to the direction of the fabric's motion, and an additional ribbon-holding clamp to temporarily hold the ribbon while it is cut by an additional ribbon cutting apparatus.

By using these structures it is possible to make ribbon pieces selectively in the U-shape taught in DE-PS No. 28 41 586, the V-shape or a shape formed by folding the ribbon on itself and to feed that folded ribbon piece to the appropriate place on the moving textile fabric.

The basic concept of the invention is that ribbon pieces may be formed in a V-shape or in a shape formed by folding the cut ribbon on itself, for example as in patent DE-PS No. 28 41 586, if the front edge of the fold plate is used as a fold edge and an additional ribbon feed, cutting and positioning apparatus is provided. The additional ribbon feed either crosses the original feed path directly or with some clearance.

Advantageously the fold plate is rotatable around a slight angle from a starting position parallel to the plane of the textile fabric with the fold plate lying so that its fold edges are outside the projection of the ribbon. In this angle the fold plate is advanced until it is positioned in an intermediate position under the ribbon. After this intermediate position is attained the fold plate is rotatable into a parallel position slidable toward the open end of the conveying clamp.

It is also advantageous that the additional ribbon feed apparatus and ribbon-holding clamp for the additional ribbon be rotatable around the central point of an imaginary axis directed along the direction of the fold plate's travel through the slots the fold plate travels through and lying in the plane of the textile fabric or in an imaginary plane parallel thereto.

When the ribbon piece is inserted into the conveying clamp by the fold plate each of the free ends of the ribbon piece lies in the recess in front of the slot mouth of the clamp. These free ends are placed on the textile fabric but directed away from the conveying clamp as the ribbon piece is discharged.

An especially advantageous structure for the ribbon feed apparatus comprises a pair of opposed flat rails parallel to one another between which the ribbon may be threaded, the units being capable of being moved with the strip toward the ribbon-holding clamp but having recesses into which the clamp can reach to engage the strip, so that the rails may then be drawn back to the rest position exposing the ribbon held fast by the ribbon-holding clamp to the ribbon cutting apparatus. A pair of rollers are positioned directly ahead of the latter to press the rails together to hold the ribbon tightly while it is being moved to the ribbon-holding clamp.

BRIEF DESCRIPTION OF THE DRAWING

The above and other objects, features and advantages of my present invention will become more readily apparent from the following description, reference being made to the accompanying drawing in which.

SPECIFIC DESCRIPTION

Figure 1:
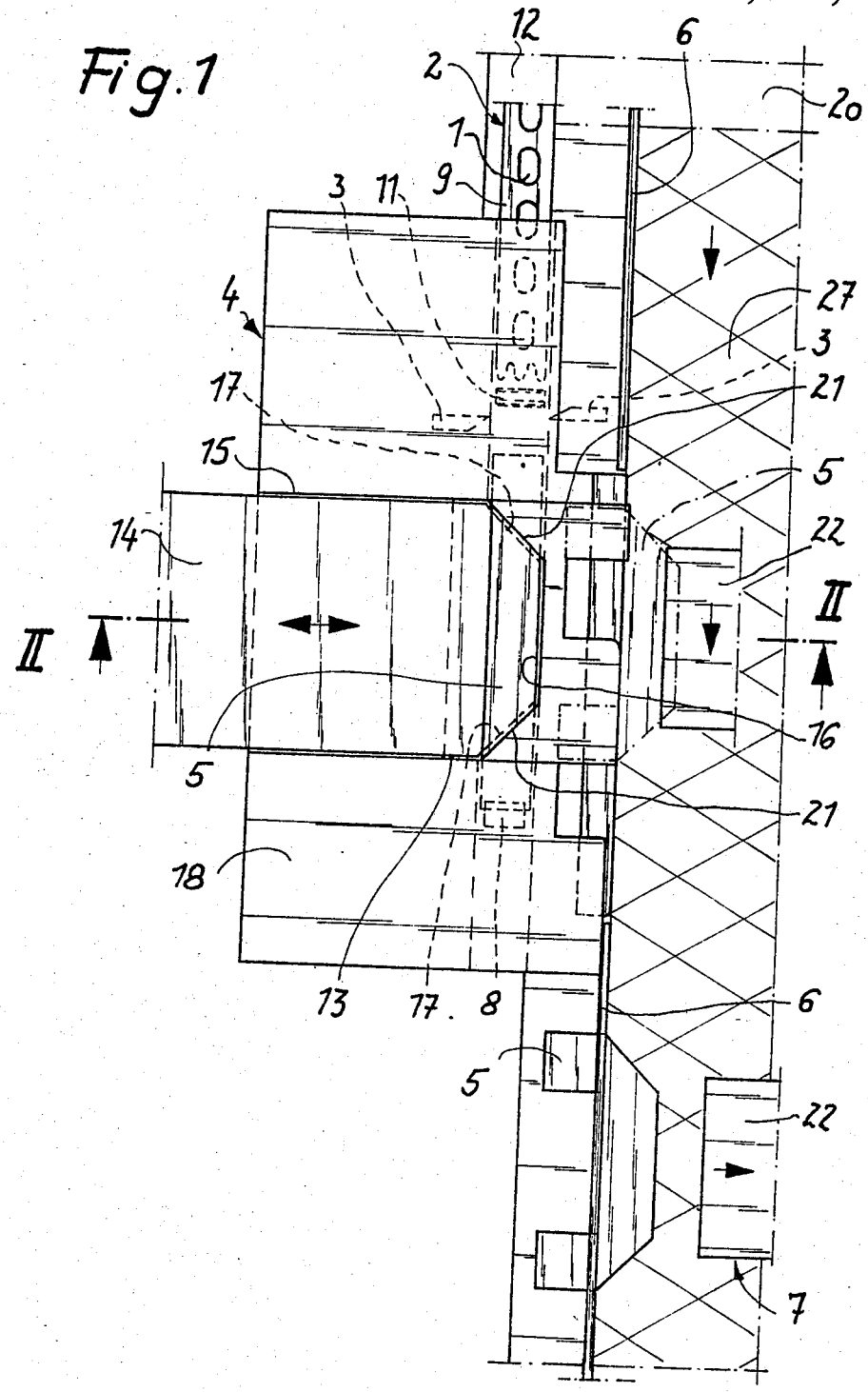
FIG. 1 is a top plan view of part of the novel apparatus for applying folded ribbon pieces on the edge of a textile fabric in which the ribbon piece is formed in the shape of a U.
Figure 1A:
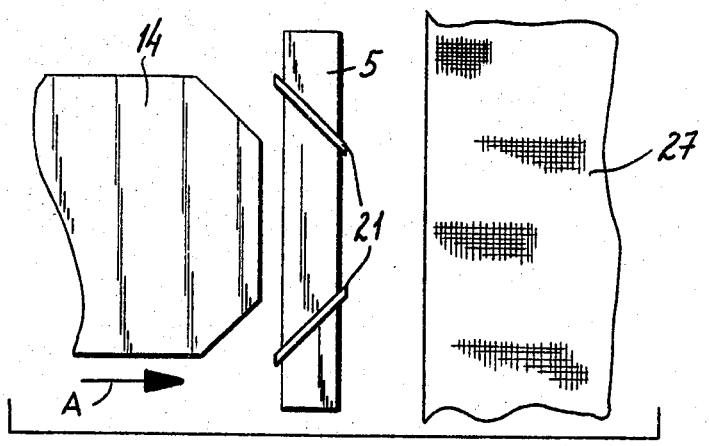
FIGS. 1A–1F are diagrammatic plan views illustrating successive steps in the operation.
Figure 1B:
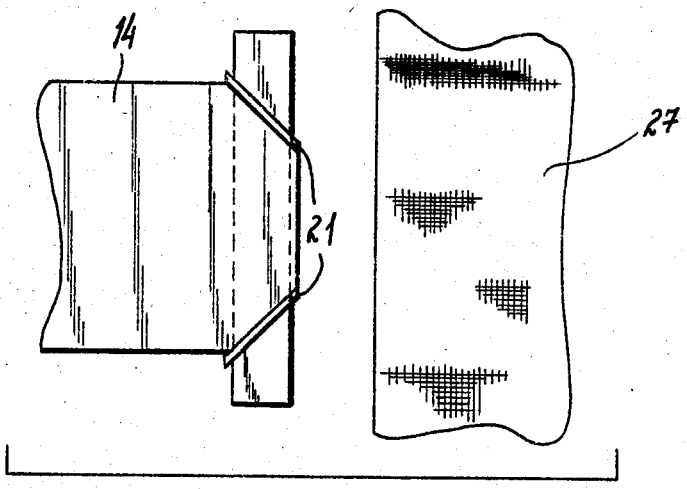
Figure 1C:
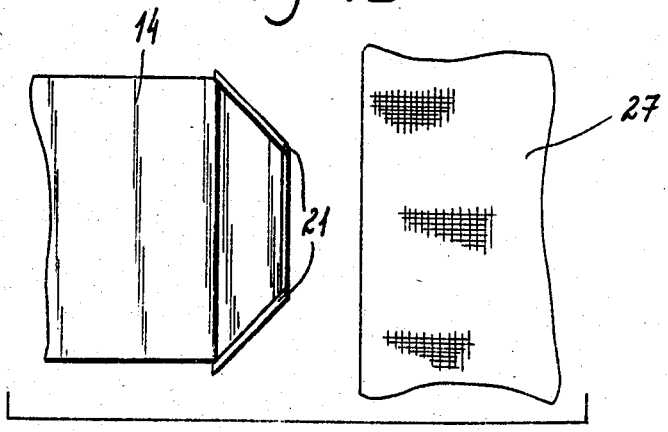
Figure 1D:
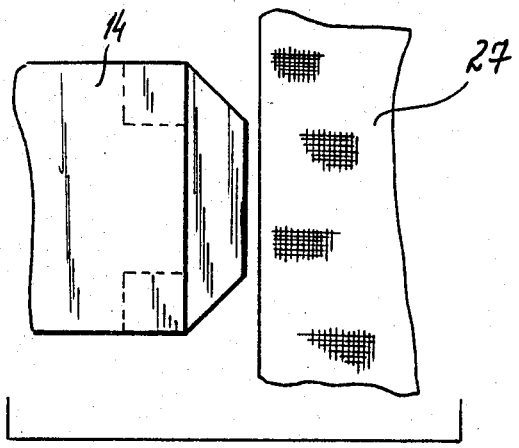

The apparatus of this invention basically operates with a ribbon 1 and an additional ribbon 1′ fed from ribbon rolls or spools not shown. The apparatus comprises an intermittently operated ribbon feed unit 2 or 2′, an adjustable ribbon cutting unit 3 or 3′, and a ribbon folding unit 4 controlled so that a folded cut ribbon piece 5 or 5′ is subsequently fed under a piece holder 6 onto a textile fabric 20*a*, for example a hand towel, to be transported to a folding and hemming apparatus, by a controllable conveying apparatus 7.

The apparatus controls are constructed as conventional sequencing or step-by-step controls using limit switches to trigger each successive step. These controls can be automatically monitored electrically by continuous measurements so that functioning is maintained and features or faults readily ascertained.

On input of ribbon 1 or 1′ the ribbon 1 or 1′ will be advanced by means of a motorized or pneumatic adjustable ribbon advancing apparatus 2 or 2′ into an allotted feed channel and will be fed to a suitably positioned ribbon-holding clamp 8 or 8′ positioned in the ribbon advancing channel.

Each ribbon feed unit 2 or 2′ is comprised of two flat rails 9 or 9′ and 10′ or 10′ positioned parallel to one another between which the ribbon 1 or 1′ is threaded.

Figures 6, 7, 8, 9, 10:
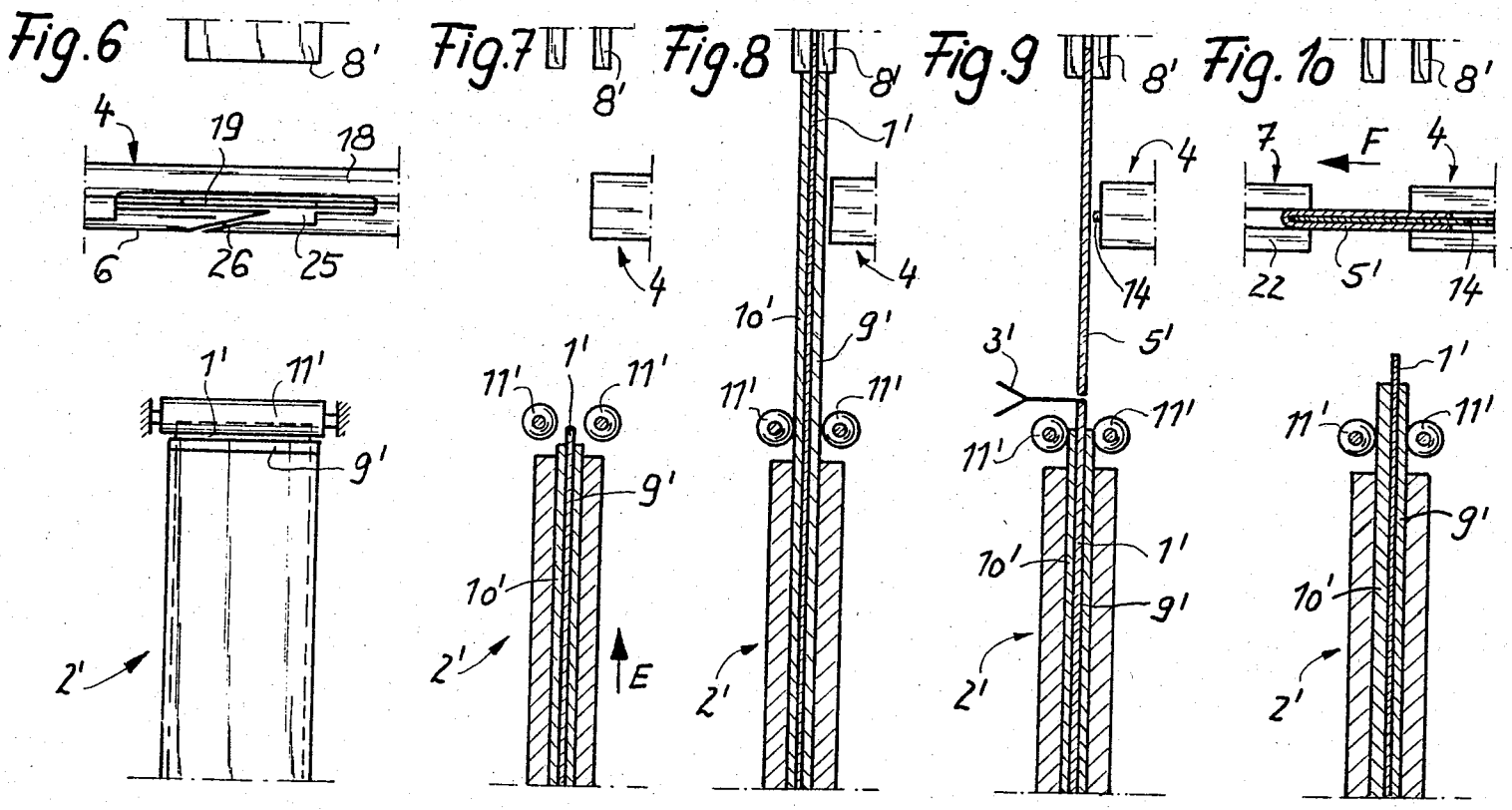
FIGS. 6–10 are sectional views showing successive steps in the operation of part of the apparatus of FIG. 5.

In the rest position shown in FIG. 7, rails 9 or 9′ and 10 or 10′ are spaced slightly from one another so that ribbon 1 or 1′ is easily threaded.

Directly in front of the forward end of rails 9 or 9′ and 10 or 10′ a pair of rollers 11 or 11′ are positioned, through which the rails 9 or 9′ and 10 or 10′ will pass and be pressed together during the motorized or pneumatic feed. Thus ribbon 1 or 1′ is held fast and not displaced relative to rails 9 or 9′ and 10 or 10′ during feed to the ribbon-holding clamp.

The rails 9 or 9′ and 10 or 10′ show a U-shaped recess on their forward ends in their direction of advance in which the clamp 8 or 8′ is engageable so that the ribbon 1 or 1′ will be grasped and held by the clamp 8 or 8′ while the rails 9 or 9′ and 10 or 10′ are retracted.

As soon as the rails return to the resting position, the ribbon 1 or 1′ will be cut through near the rails 9 or 9′ and 10 or 10′ by means of the ribbon cutting unit 3 or 3′.

Figure 5:
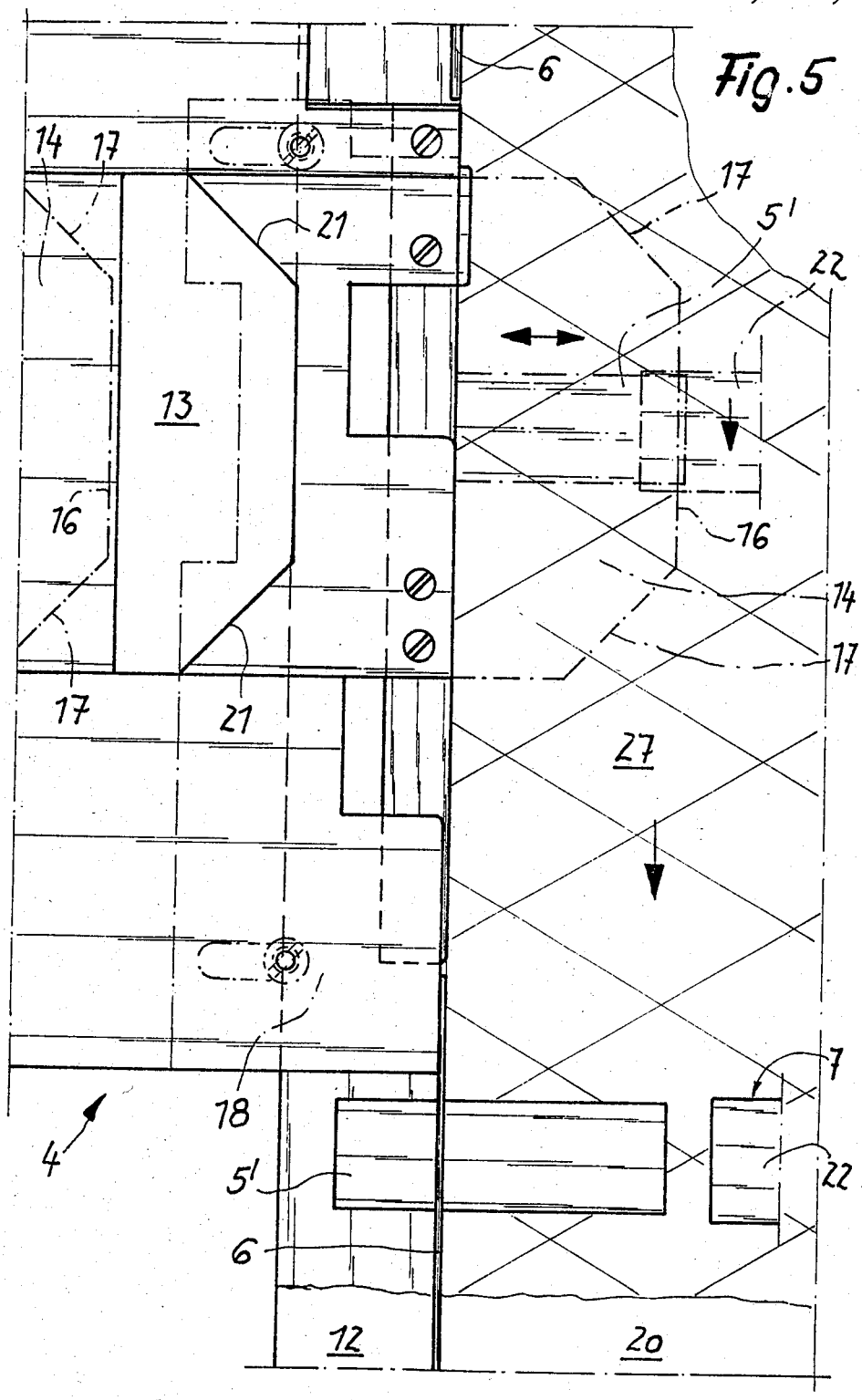
FIG. 5 is a top plan view of part of the embodiment of FIG. 1 in which the shape of the ribbon strip is determined by folding it over on itself.

In the embodiment shown in FIG. 1 the ribbon 1 lies on an auxiliary support or table 12. By contrast, however, ribbon 1′ hangs vertically downward under the force of gravity according to the specific embodiment shown in FIG. 5. The auxiliary support 12 for the ribbon 1′ and the ribbon feed device 2′ has a passage 13 cooperating with the fold plate 14.

The ribbon folding device 4 comprises the fold plate 14 which is positioned slidably and longitudinally in a guide 15. To power the advance and retraction of the fold plate 14, a pneumatic cylinder can be provided which engages the outer end of the fold plate 14.

The fold plate 14 has a fold edge 16 running transverse to the displacement of fold plate 14 so as to connect two lateral slanted converging fold edges 17.

An auxiliary support 18 serving as a guide for the motion of fold plate 14 is provided with a slot 19 through which fold plate 14 passes.

The foregoing apparatus is held together as an essentially unified structure at the edge of supporting table 20 over which the moving textile fabric 27 or 20*a* passes.

The support table 20 is formed in the customary way and provides a stable base on which the transport unit for the textile fabric at the edge matching station aligns the fabric edgewise correctly.

The apparatus for putting ribbon pieces 5 or 5′ on the textile fabric 27 is customarily followed by a seam-forming sewing machine or the like.

Figure 16:
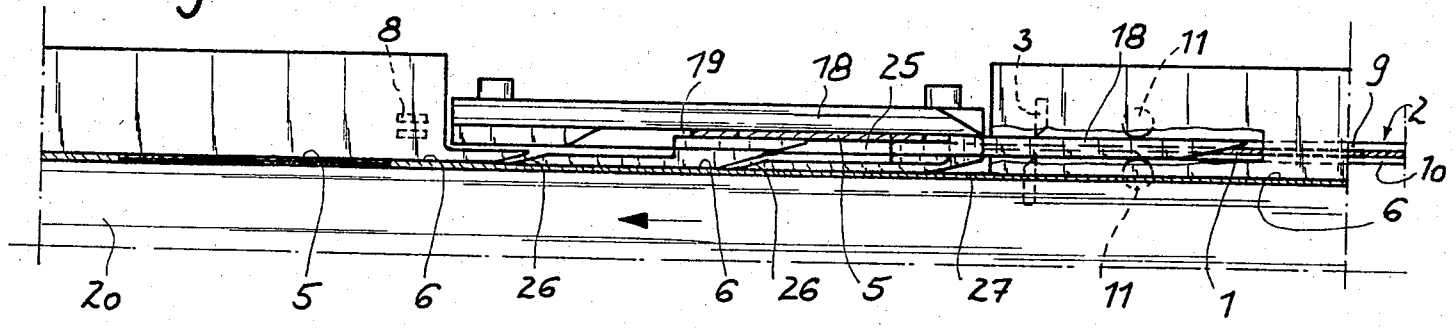
FIG. 16 is a front view of the apparatus according to FIG. 1.

The operation of the apparatus described in FIGS. 1 to 4 as well as FIGS. 16 to 18 will be described next (see also FIGS. 1A–1F).

The apparatus can form a U-shaped ribbon piece 5 which is apparent especially from FIGS. 1 and 1A–1F. As has been described already at the outset, the ribbon 1 is advanced through the ribbon feed device 2 which is then retracted and the ribbon cut by the ribbon cutting device 3 to form ribbon piece or strip 5.

Figure 2:
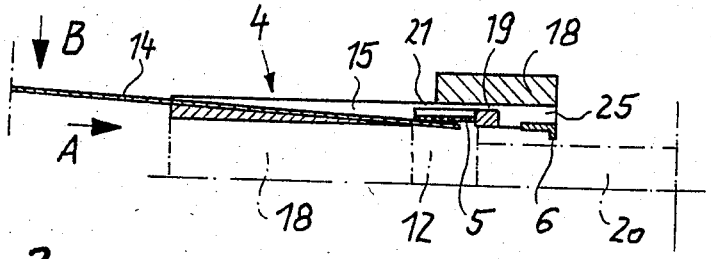
FIGS. 2–4 are side sectional views taken along the line II—II of FIG. 1 showing the operation for the embodiment of FIG. 1.

At this point the ribbon or strip 5, as is clearly made apparent from FIGS. 1 and 2, lies somewhat in the plane of the textile fabric on the support table 20.

The fold plate 14 is then swung out of its rest position so that the fold edges 16 and 17 lie outside the projection of ribbon piece 5. The fold plate 14 is slightly tilted with respect to the plane of the textile fabric 27 and the support table 20 by means of a pneumatic cylinder (not shown) so that the position as illustrated in FIG. 2 may be reached.

In this position the fold plate 14 will be moved in the direction A until the fold edges 17 are positioned under the ribbon piece 5. The fold plate 14 is then again moved in the direction B of FIG. 2 into a position parallel to the textile fiber 27 so that the fold edges 17 engage the ribbon to form the correctly folded ribbon piece 5 cooperating with fold plate stops 21 at auxiliary support 12. During the motion of fold plate 14 in the direction B the clamp 8 is opened so that ribbon piece 5 may be formed.

Figure 3:
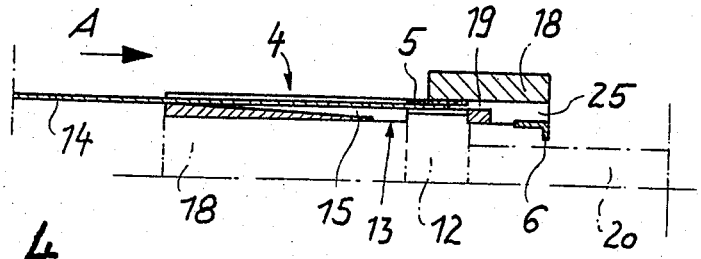
Figure 4:
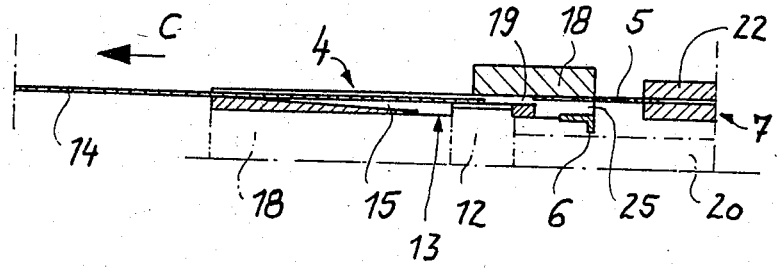

The fold plate 14 is again advanced in the direction A as shown in FIG. 3 so that ribbon piece 5 is forced through slot 19 and fed into the slot found in conveying device 7.

The conveying device 7 comprises an at least approximately horizontally oriented conveying clamp 22 having two jaws, an upper jaw which can engage the upper side of fod plate 14 and a lower jaw which can engage the underside of fold plate 14. The engaging surfaces of the conveying clamp 22 are conformed so as to be able to hold the ribbon piece 5 securely when each is formed so that after the retraction of fold plate 14 in the direction C of FIG. 4 the ribbon piece 5 is held by the clamp 22 in the correct position.

Figure 17:
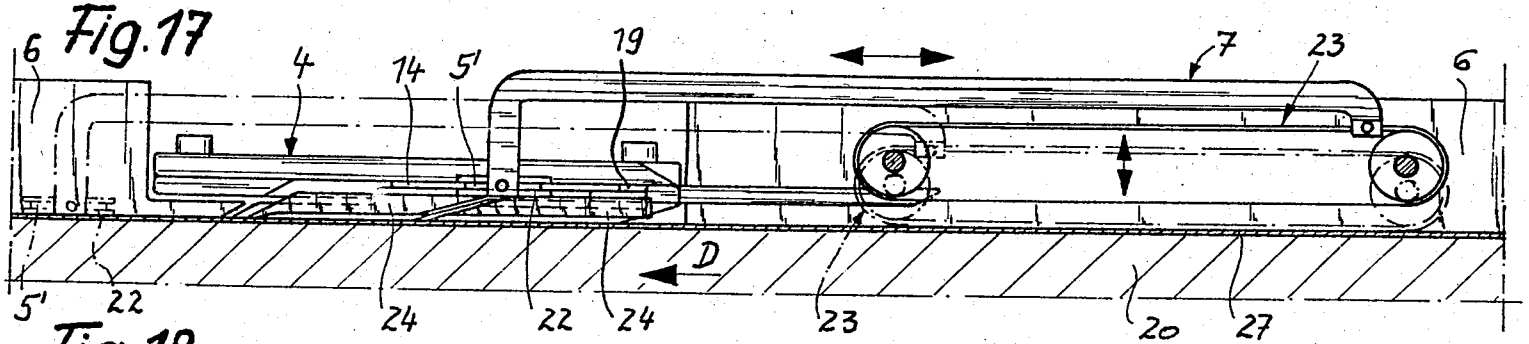
FIGS. 17 and 18 are side and top plan views showing the operation of the conveying clamp.
Figure 18:
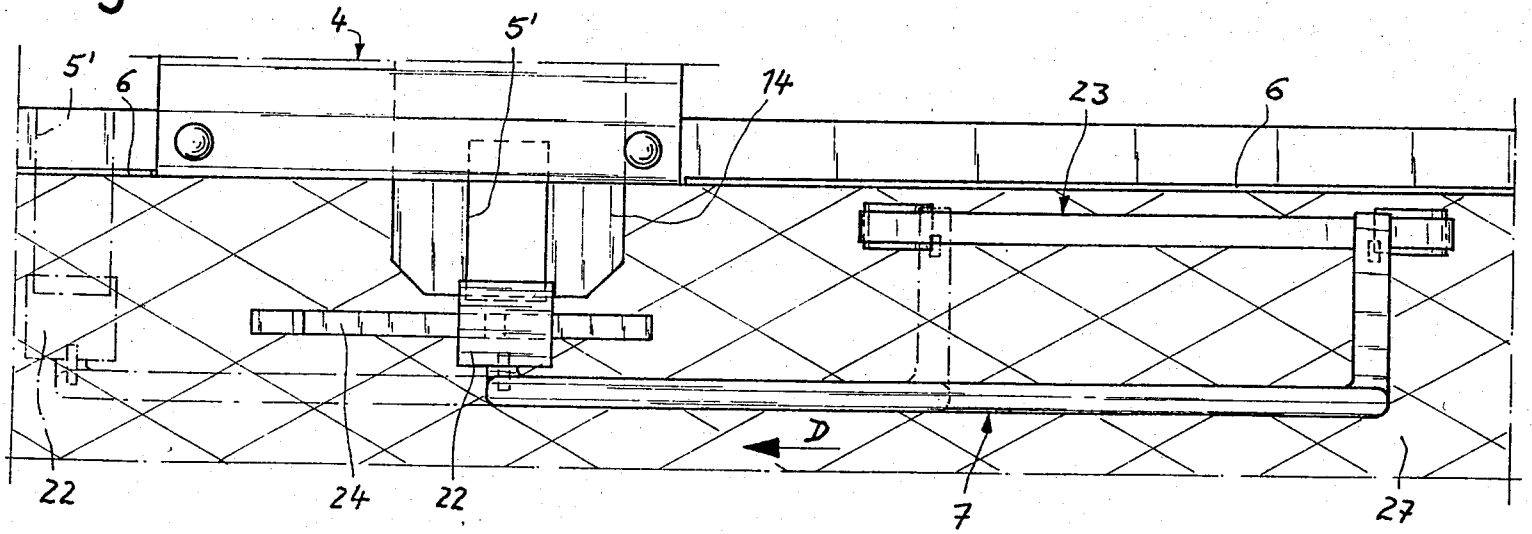

The clamp 22 of the conveying device 7 illustrated in FIGS. 17 and 18, can be lowered to the advancing textile fabric 27, and thus support table 20, and is movable parallel to the textile fabric 27 until it lies within the range of action of piece holder 6.

The conveying device 7 further comprises a conveying clamp 22 which is coupled by a toggle joint or bell crank lever to the upper strand or pass of a belt drive 23.

As soon as the conveying clamp 22 has engaged the ribbon piece, in this example ribbon piece 5, the belt drive 23 is controlled by a conventional system detecting the position of the moving textile fabric 27 on the support table 20 to ensure that the speeds of clamp 22 and of the textile fabric 27 are the same.

Figure 1E:
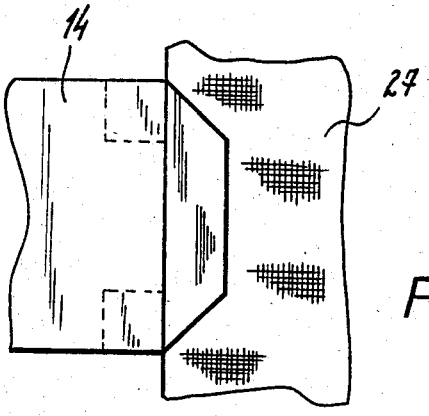
Figure 1F:
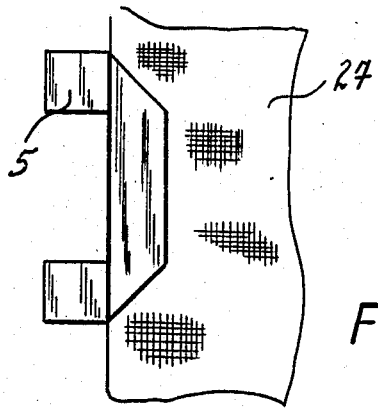

As shown in FIG. 17 the conveying clamp 22 is then held in position fixed at the level of slot 19 by a curved support piece or cam 24. As soon as conveying clamp 22 moves following engagement of drive belt 23 in the direction D of FIG. 17, it runs above and on the curved support piece 24 until it reaches the level of support table 20 and textile fabric 27. During that motion the free ends of ribbon piece 5 find themselves in clearance space 25 of auxiliary piece 18 and in slot 19 positioned before the mouth of slot 26 which slants downward to the textile fabric 27. The conveying motion conveying clamp 22 together with ribbon segment 5 will thus feed the free end of the ribbon segment 5 or 5' to the textile fabric forceably under the piece holder 6 in folded form (FIGS. 1E and 1F). When piece holder 6 has been reached the conveying clamp 22 after a relatively short travel releases ribbon piece 5 and retreats to its original position.

In this embodiment the original position of conveying clamp 22 will be restored through a pneumatic retrieval cylinder, whereby the belt drive 23 will be brought out of engagement with the support table 20 at the same time. In this way the return time of conveying clamp 22 of the conveying apparatus 7 will be considerably shortened which is especially advantageous with small pieces like guest hand towels and the like. During the return of conveying clamp 22 it rides on the cam 24 so that it returns to the correct position in front of slit 19.

The clamp jaws are again opened so that the fold plate 14 can advance the next ribbon piece 5 and the procedure repeats. Regarding the U-shaped ribbon segment 5 two clearance spaces 25 and therefore two slots 26 are provided. With the other shapes for the ribbon piece 5' only one clearance space 25 and slot 26 will be utilized.

The function of the apparatus according to FIGS. 5 to 13 and 15 to 18 is as follows. First the ribbon 1' is fed to the ribbon feed device 2' comprising the rails 9' and 10' and the pair of rollers 11' into ribbon-holding clamp 8'. These operations are shown schematically in FIGS. 6 to 10. FIG. 6 is a view seen in the direction of the displacement of the fold plate 14. The apparatus of FIG. 6 is shown in a side view in FIGS. 7 to 10. In FIG. 7 it is clear that the rails 9' and 10' hold the ribbon 1' relatively loosely at first. After a slight displacement in the direction E the rollers 11' engage the outside of the rails 9' and 10' whereby the rails 9' and 10' will be strongly pressed to prevent relative motion between the ribbon 1' and the rails 9' and 10'. The rails 9' and 10' are moved by a force provided for example by an electric motor or a pneumatic apparatus until ribbon-holding clamp 8' engages and grips the free end of ribbon 1'. This is shown in FIG. 8.

Concurrently the rails 9' and 10' will be retracted at least into the position shown in FIG. 9.

Subsequently the ribbon 1' is cut with ribbon cutting device 3' to form ribbon piece 5'. The ends of the cut ribbon hang vertically under the force of gravity until it is engaged by fold plate 14 to form the folded ribbon piece 5'.

Figure 11:
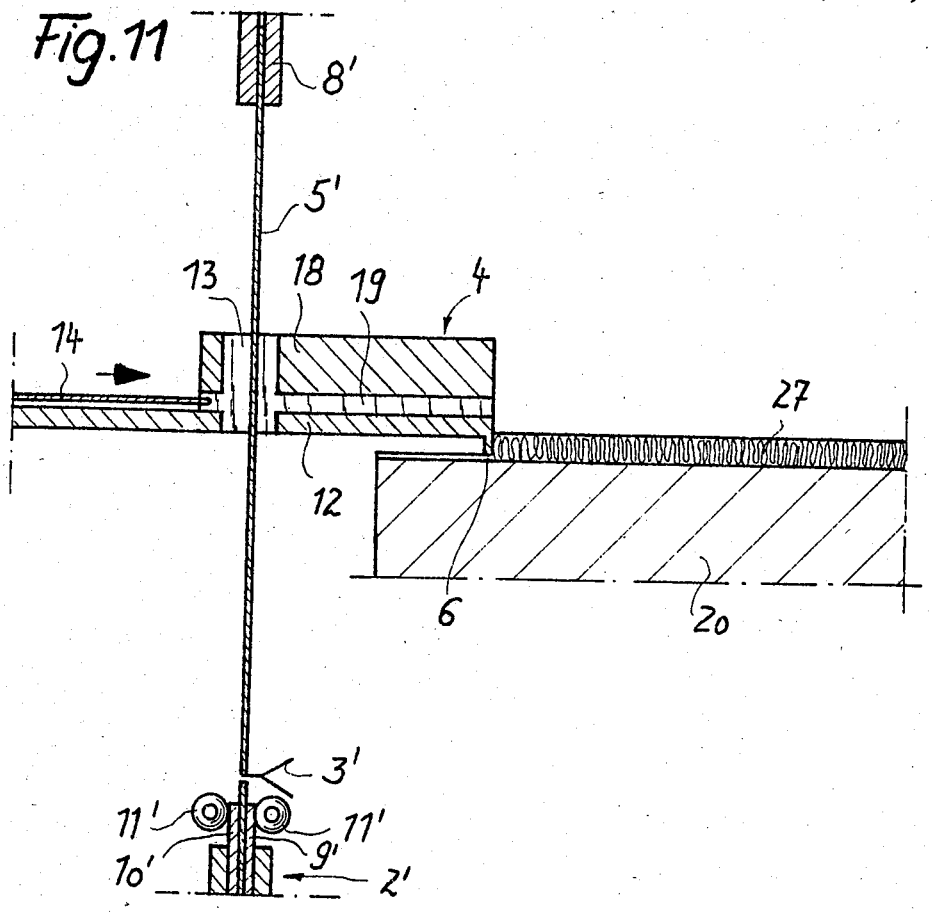
FIGS. 11 and 12 are further schematic views showing the operation of the apparatus according to FIG. 5.
Figure 12:
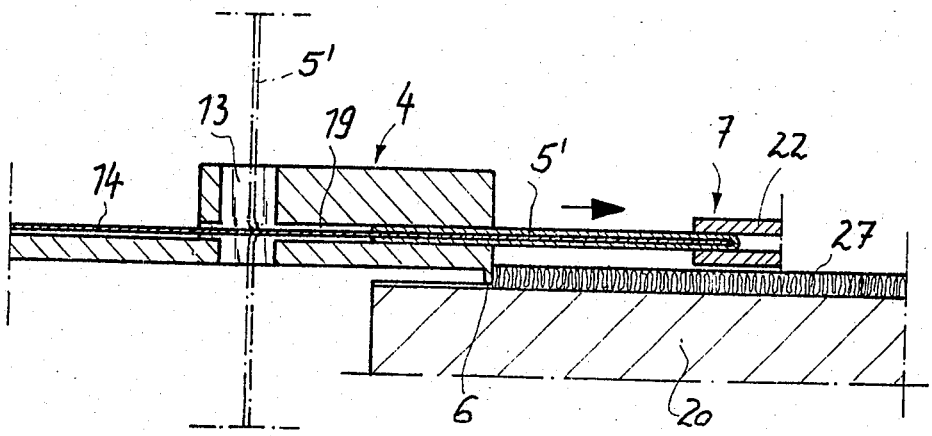

The fold plate 14 is then displaced in the direction F whereby the ribbon segment 5' is fed into slot 19. At nearly the same time clamp 8' opens so that the ribbon piece 5' is not held back but may enter slot 19 and clamp 22. The details of operation of the fold unit 4 are similar to those described above for ribbon piece 5. Of course the ribbon here cooperates with the fold edge 16 of fold plate 14 instead of the slanting fold edges 17. The corresponding operation of fold machine 4 is shown in FIGS. 11 and 12.

Figure 15:
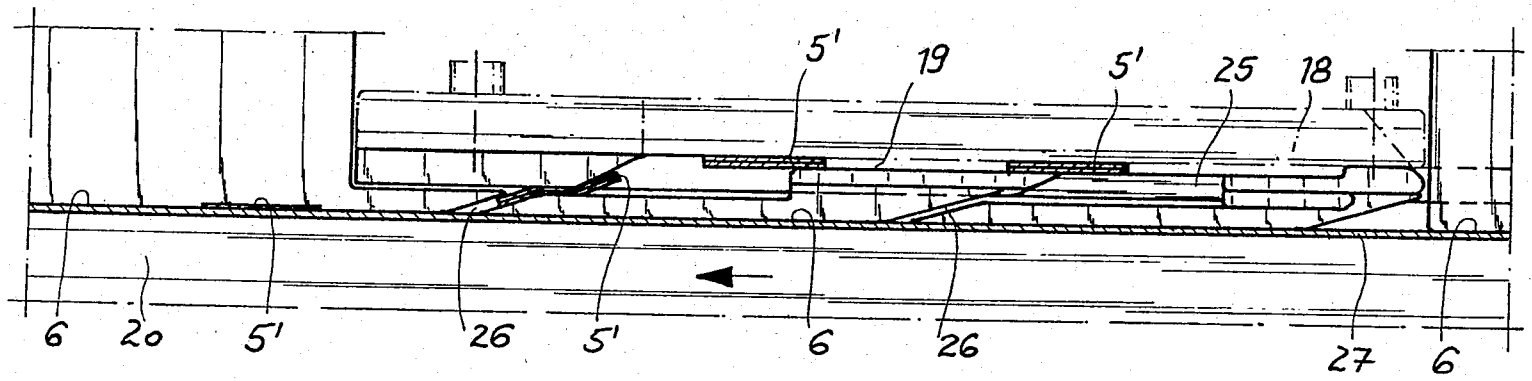
FIG. 15 is a front elevational view of the apparatus according to FIG. 5.

In FIG. 15 the transport of the ribbon piece 5' as it advances through the slot 19 with its free ends in slot 19 and into the clearance space 25 is clearly shown. It will be moved subsequently through slot 26 to the textile fabric 27 to be put under the piece holder 6 by conveying clamp 22.

Figure 13:
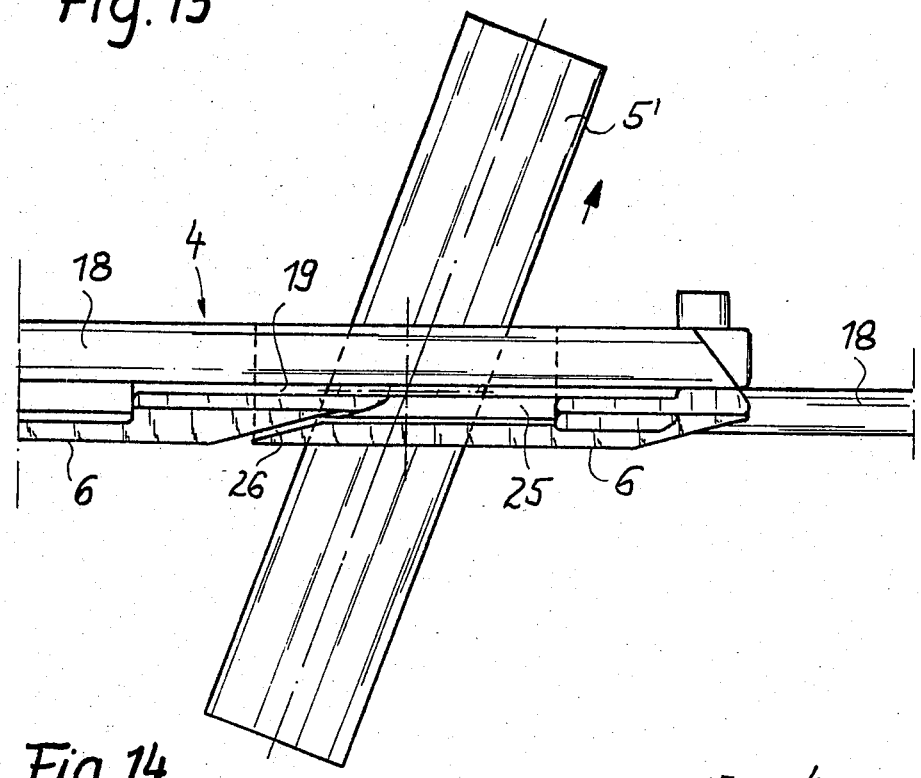
FIGS. 13 and 14 show the novel apparatus according to FIGS. 5 to 12 with the ribbon feed apparatus positioned at an alternative angular position to produce V-shaped ribbon pieces.
Figure 14:
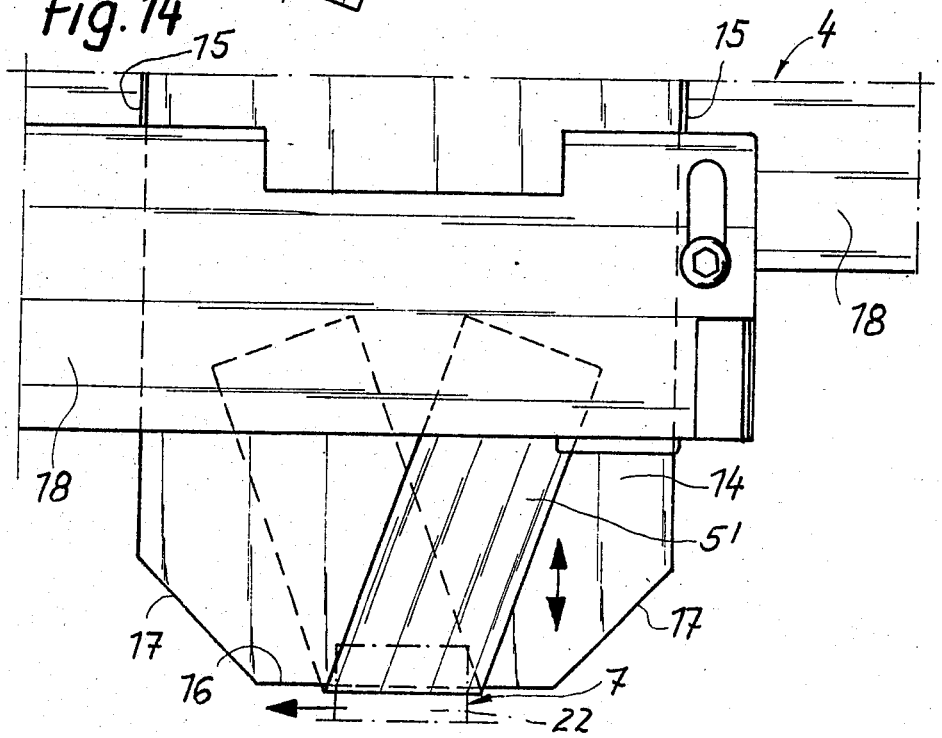

In FIGS. 13 and 14 a further variation of the apparatus of this invention as shown in FIGS. 5 to 12 is illustrated. Here the ribbon feeding apparatus 2', the ribbon-holding clamp 8', and the ribbon cutting apparatus 3' are rotated about a pivot point at an angle, the pivot point lying near the middle of slot 19. In this way a V-shaped ribbon piece 5' may be formed using the fold edge 16 or fold plate 14. The further operation is similar to that already described.

I claim:

1. In an apparatus for applying a ribbon strip cut and folded from a ribbon band on an edge of a moving textile fabric, fabric piece or the like, wherein said ribbon is fed to a folding unit from a feed unit, said feed unit being coupled to an adjustable ribbon cutting unit so as to produce a folded ribbon strip, said ribbon strip being subsequently conveyed to said textile fabric and inserted under a piece holder positioned above said textile fabric by a conveying unit, said ribbon folding unit comprising a fold plate having two long sides, each of said long sides having a slanting converging fold edge thereon, said fold edges cooperating with two fold plate fingers and being slidable across the path of said ribbon to engage and suitably fold said ribbon strip, the improvement wherein:

said fold plate is formed with an additional fold edge at a leading end of said fold plate parallel to the direction of motion of said textile fabric;

means is provided to feed an additional ribbon to said folding unit so as to be engageable by said additional fold edge, said additional ribbon being fed so as to be oriented transverse to and at an angle to the plane of said textile fabric;

an additional ribbon-holding clamp is disposed above the position of engagement of said fold plate and said additional ribbon; and an additional ribbon cutting unit is mounted so as to be able to cut said additional ribbon held by said additional ribbon-holding clamp so that said fold plate may engage a strip of said additional ribbon to form said folded ribbon strip.

2. An apparatus according to claim 1 wherein said angle between said additional ribbon and said plane of said textile fabric is a right angle so that said folded ribbon strip is rectangular in shape.

3. An apparatus according to claim 1 wherein said angle between said additional ribbon and said plane of said textile fabric is more acute than a right angle so that said folded ribbon strip is V-shaped.

4. An apparatus according to claim 1 wherein said folding unit is constructed and arranged so that said fold plate is retractable to a starting position outside of the projection of the first mentioned ribbon, and is rotatable from said starting position to a tilted position in which said fold plate is tilted with respect to a plane parallel to said plane of said textile fabric and in said tilted position is slidable toward and under said ribbon, said fold plate being subsequently rotatable to return said fold plate to a position parallel to said textile fabric so as to engage said slanted converging fold edges of said plate with said ribbon, and fold said ribbon to form said folded ribbon strip in a U-shape, said fold plate being advanced further to insert said ribbon strip into said conveying clamp.

5. An apparatus according to claim 1 wherein said means for advancing said additional ribbon is an additional feed unit having said additional ribbon-holding clamp for securing said additional ribbon prior to cutting thereof, said additional feed unit being adjustable about the midpoint of an imaginary axis passing through and central to said fold plate and said conveying clamp and oriented at a right angle to said plane of said textile fabric.

6. An apparatus according to claim 1 wherein the free ends of said folded ribbon strip are placed between said fold plate and a conveying clamp when said folded ribbon strip is fed to said fold plate, said free ends of said folded ribbon strip being slanted away from said conveying clamp, and said folded ribbon strip being placed on said textile fabric under said piece holder.

7. An apparatus according to claim 1 wherein said ribbon feed unit comprises two rails, each of said rails being directed parallel to the ribbon feed direction and spaced so as to oppose one another, said ribbon being threaded and held between said rails, a ribbon-holding clamp positioned to receive said ribbon, a pair of rollers positioned so that said rails slide therethrough toward said ribbon-holding clamp so that said rails are pressed together to hold said ribbon tightly when slid therethrough, and a ribbon cdtting apparatus positioned between said rollers and said ribbon-holding clamp, said ribbon feed unit bringing said ribbon to said ribbon-holding clamp by passing said rails through said rollers, closing said clamp to grasp and hold said ribbon, and retracting said rails toward said rollers so that said ribbon cutting apparatus can be operated to cut said ribbon.

* * * * *